US008831450B2

(12) United States Patent
Hano

(10) Patent No.: US 8,831,450 B2
(45) Date of Patent: Sep. 9, 2014

(54) ELECTROPHOTOGRAPHIC IMAGE FORMING APPARATUS CONTROLLING VOLTAGE AND CURRENT IN CHARGING MEMBERS

(75) Inventor: Masami Hano, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 225 days.

(21) Appl. No.: 13/357,009

(22) Filed: Jan. 24, 2012

(65) Prior Publication Data

US 2012/0201553 A1 Aug. 9, 2012

(30) Foreign Application Priority Data

Feb. 3, 2011 (JP) ..... 2011-021572

(51) Int. Cl.
*G03G 15/02* (2006.01)

(52) U.S. Cl.
USPC ..... 399/50

(58) Field of Classification Search
USPC ..... 399/50, 174–176
See application file for complete search history.

(56) References Cited

U.S. PATENT DOCUMENTS 4,959,688 A * 9/1990 Koitabashi ..... 399/148
5,842,081 A * 11/1998 Kaname et al. ..... 399/50
7,457,555 B2 11/2008 Nakamura
2004/0005171 A1* 1/2004 Inoue et al. ..... 399/174
2005/0013631 A1* 1/2005 Nishihama et al. ..... 399/174
2008/0131155 A1* 6/2008 Kobashi et al. ..... 399/50

FOREIGN PATENT DOCUMENTS

CN 1858659 A 11/2006
JP 07-199604 A 8/1995
JP 08-272194 A 10/1996
JP 2001-312125 A 11/2001

OTHER PUBLICATIONS

Office Action in Chinese Patent Application No. 201210023610.4, dated Feb. 21, 2014.

* cited by examiner

*Primary Examiner* — Walter L Lindsay, Jr.
*Assistant Examiner* — Rodney Bonnette
(74) *Attorney, Agent, or Firm* — Fitzpatrick, Cella, Harper & Scinto

(57) ABSTRACT

An image forming apparatus includes a rotatable image bearing member; a first charging member for electrically charging the image bearing member; a second charging member, provided downstream of the first charging member with respect to a rotational direction of the image bearing member, for electrically charging the image bearing member; an applying device for applying a voltage to the first charging member and the second charging member; a detecting device for a DC current passing through the second charging member; and a controller for controlling, when an AC voltage and a DC voltage are applied to the second charging member while a DC voltage is applied to the first charging member, the DC voltage applied to the second charging member so that an absolute value of the DC current detected by the detecting device is within a predetermined range.

2 Claims, 14 Drawing Sheets

ELECTROPHOTOGRAPHIC IMAGE FORMING APPARATUS CONTROLLING VOLTAGE AND CURRENT IN CHARGING MEMBERS

FIELD OF THE INVENTION AND RELATED ART

The present invention relates to an image forming apparatus of an electrophotographic type and relates to the image forming apparatus including a plurality of charging members for electrically charging an image bearing member in contact with the image bearing member.

The image forming apparatus employing a charging type in which an electroconductive roller type charging member is brought into direct contact with or near to the image bearing member to charge the image bearing member has been conventionally commercialized. Further, in recent years, the image forming apparatus has been required to output a large number of prints per unit time. For that reason, a rotational speed of a photosensitive drum is increased and, e.g., a charging roller is contacted to the photosensitive drum which is the image bearing member. Further, the charging roller is constituted so as to be rotated by rotation of the photosensitive drum, and a voltage is supplied to the charging roller to uniformly charge the photosensitive drum.

However, with respect to the photosensitive drum which rotates at high speed, a contact portion between the charging roller and the photosensitive drum is liable to become unstable and therefore charging non-uniformity is liable to occur. Accordingly, it was difficult to use such a charging roller as a charging device for the photosensitive drum or the like in a high-class image forming apparatus, such as a high-speed copying machine, which is, e.g., required to have high reliability and provides a large copy volume.

Therefore, as described in Japanese Laid-Open Patent Application (JP-A) Hei 8-272194 and JP-A 2001-312125, in order to stabilize a surface potential at a contact charging means from an initial stage over a long term to improve an image quality, the contact charging means includes two or more independent contacts. Further, it is known that a bias in the form of a DC voltage superposed with an AC voltage is applied to a second contact charging member, provided downstream of a first contact charging member first contacted to the image bearing member surface, contacted to the image bearing member surface.

In a contact charging type using the charging roller, the electroconductive member is press-contacted to the photosensitive drum and is supplied with a voltage to cause electric discharge, thus charging the photosensitive drum. Specifically, there is a DC charging type in which the photosensitive drum is charged by applying a DC voltage which is the sum of a discharge start voltage (about 600 V in the case where the charging roller is press-contacted to an OPC photosensitive member) and a necessary surface potential Vd of the photosensitive drum. Further, for the purpose of improving a potential fluctuation due to a fluctuation of environment and durability, there is an AC charging type. In the AC charging type, the photosensitive drum is charged by applying to the charging roller a voltage in the form of a DC voltage, corresponding to the necessary surface potential Vd of the photosensitive drum, biased with an AC (voltage) component including a peak-to-peak voltage which is two times the discharge start voltage.

The DC charging type has, compared with the AC charging type, the advantages that it is small in electric power consumption and is inexpensive in general and that the charging device is small in size and thus space saving can be realized.

However, compared with a corona charging type which is a non-contact type, in the contact charging type using the charging roller, there is a current status such that the charging roller as the contact charge is contaminated by deposition of a scattering matter such as a toner or an external additive due to a change with time and depending on the type of an image to be formed.

In order to solve this problem, JP-A Hei 7-199604 has proposed a constitution in which a deposited matter is removed, by providing a constitution in which a cleaning member for the charging member is provided for permitting uniform charging by the contact charging member, thereby to realize the uniform charging.

However, the present inventor noted that the following problem was left in the constitution including the cleaning member for the charging roller.

That is, even when the charging roller is cleaned by the charging member cleaning member, cleaning power is deteriorated with time, so that the scattering matter, such as the toner or the external additive, which is not completely, removed remains on the charging roller. As a result, a resistance distribution of a surface layer of the charging roller is fluctuated by the remaining scattering matter and therefore in the charging device to which a certain charging high-voltage is applied, the photosensitive drum cannot be charged uniformly.

On a copy on which the image is formed in such a state, image defect which is called charging non-uniformity is generated in parallel to a print direction.

SUMMARY OF THE INVENTION

According to an aspect of the present invention, there is provided an image forming apparatus comprising: a rotatable image bearing member; a first charging member for electrically charging the image bearing member in contact with the image bearing member; a second charging member, provided downstream of the first charging member with respect to a rotational direction of the image bearing member, for electrically charging the image bearing member in contact with the image bearing member; an applying device for applying a voltage to the first charging member and the second charging member; a detecting device for a DC current passing through the second charging member; and a controller for controlling, when an AC voltage and a DC voltage are applied to the second charging member while a DC voltage is applied to the first charging member, the DC voltage applied to the second charging member so that an absolute value of the DC current detected by the detecting device is within a predetermined range.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Hereinbelow, the image forming apparatus according to the present invention will be described with reference to the drawings.

<Embodiment 1>

Figure 1:
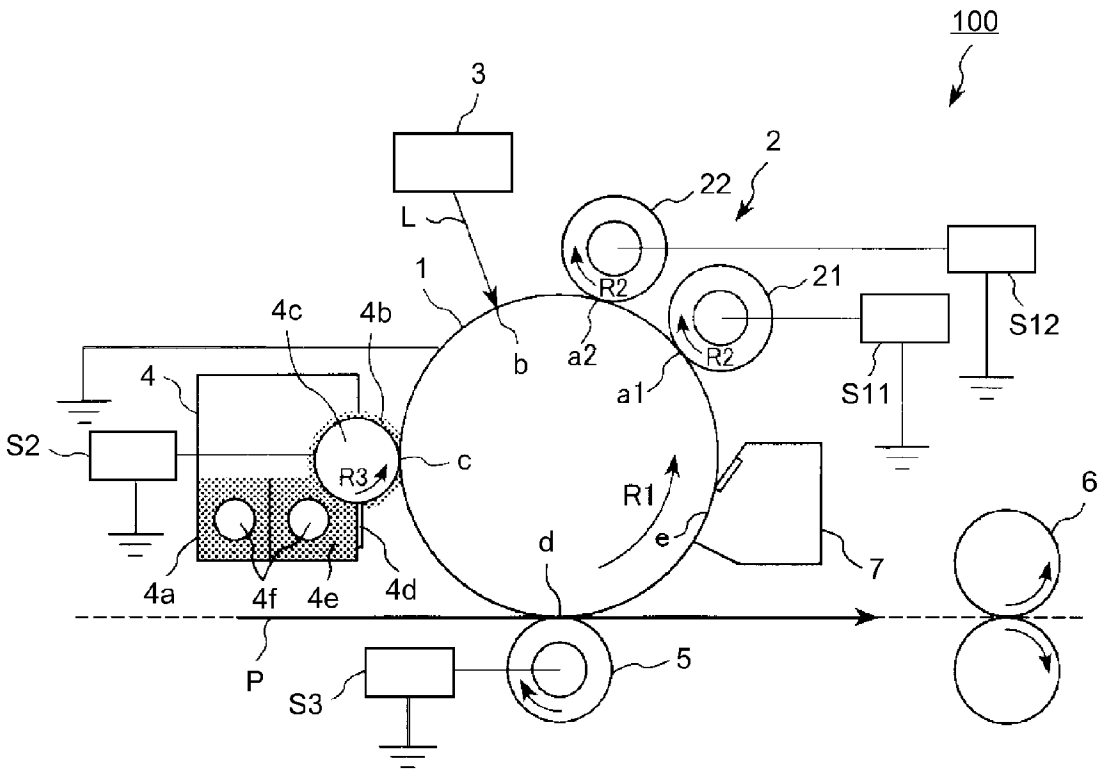
FIG. 1 is a schematic illustration of an image forming apparatus in Embodiment 1 according to the present invention.

FIG. 1 is a schematic illustration of an embodiment of the image forming apparatus according to the present invention. In this embodiment, the image forming apparatus 100 is a laser beam printer of a potential photographic type which employs a contact charging type.

As shown in FIG. 1, the image forming apparatus 100 includes a rotatable drum-type electrophotographic photosensitive member 1 as a first image bearing member (hereinafter referred to as a photosensitive drum).

In this embodiment, the photosensitive drum 1 is a negatively chargeable organic photoconductor (OPC) photosensitive member having an outer diameter of 30 mm and is rotationally driven about its center shaft at a process speed (peripheral speed) of 130 mm/sec in a direction indicated by an arrow R1 (counterclockwise direction).

The photosensitive drum 1 is constituted by coating a photocharge generating layer, and a charge transporting layer (thickness: about 20 μm) in this order on the surface of an aluminum-made cylinder (electroconductive drum substrate).

As shown in FIG. 1, the image forming apparatus 100 includes, as a contact charging means 2 for uniformly charging the photosensitive drum surface, a first charging member (charging roller) 21 and a second charging member (charging roller) 22 which is provided downstream of the first charging roller 21 with respect to a photosensitive drum movement (rotational) direction. Each of the charging rollers 21 and 22 charges the photosensitive drum 1 by using a discharge phenomenon generated in a minute gap between itself and the photosensitive drum 1.

Here, the first charging roller 21 and the second charging roller 22 will be described.

In this embodiment, the first charging roller 21 and the second charging roller 22 which have the same dimension and material were used. Herein, the first charging roller 21 is described but with respect to a portion which is not specifically described, the second charging roller 22 has the same constitution.

Figure 2:
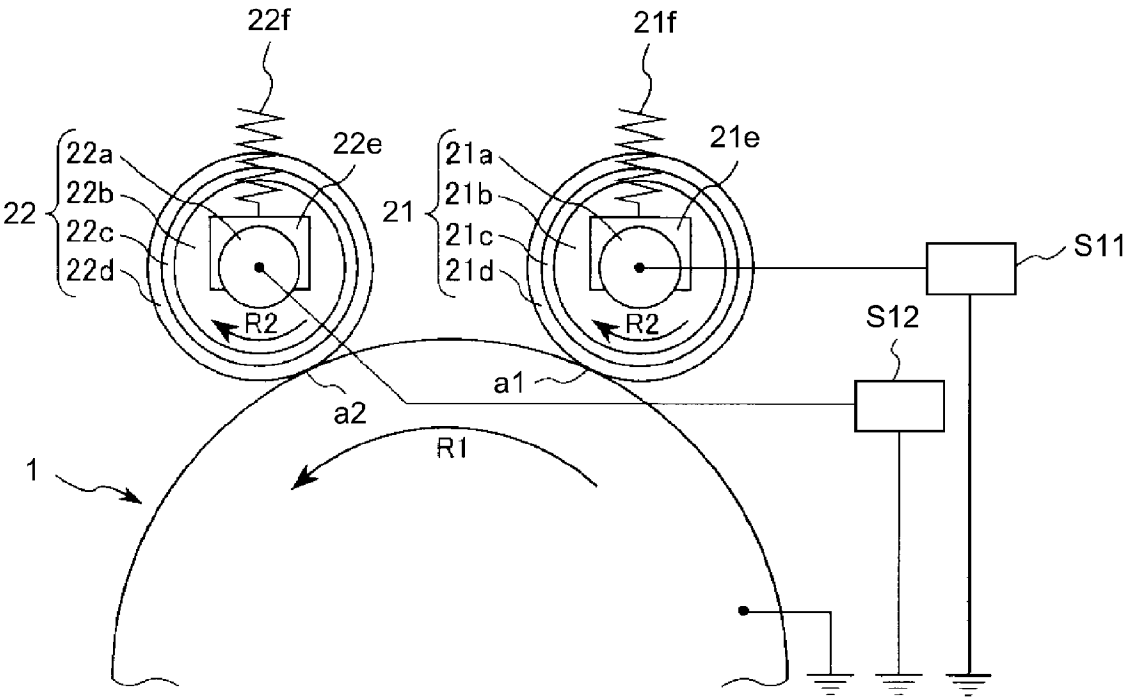
FIG. 2 is a schematic illustration of a charging roller in the present invention.

As shown in FIG. 2, the charging roller 21 is rotatably held (supported) by a bearing member 21*e* at each of end portions of a core metal (supporting member) 21*a*. Further, the charging roller 2 is urged toward the photosensitive drum 1 by an urging spring 21*d*, thus being press-contacted to the photosensitive drum 1 with a predetermined urging force.

As a result, the charging roller 21 is rotated in a direction indicated in the figure by a curved arrow R2 (clockwise) by the rotation of the photosensitive drum 1. A press-contact portion between the photosensitive drum 1 and the charging roller 2 is a charge portion (charging nip) a1. Further, a press-contact portion between the photosensitive drum 1 and the charging roller 22 is a charging portion (charging nip) a2.

The charging roller 21 has a longitudinal length of 330 mm and a diameter of 14 mm. As shown in a layer structure in FIG. 2, the charging roller 21 has, around the core metal (supporting member) 21*a*, a three-layer structure consisting of a lower layer 21*b*, an intermediary layer 21*c*, and a surface layer 21*d* which are successively laminated in this order.

The core metal 21*a* is a stainless steel rod with a diameter of 6 mm. The lower layer 21*b* is a layer of carbon-dispersed foam EPDM (ethylene-propylene-diene rubber) (specific gravity: 0.5 g/cm$^3$, volume resistivity: $10^7$-$10^9$ ohm.cm, layer thickness: about 3.5 mm). The intermediary layer 21*c* is a layer of carbon dispersed NBR (nitrile-butadiene rubber) rubber (volume resistivity: $10^2$-$10^5$ ohm.cm, layer thickness: about 500 μm).

The surface layer 21*d* is a layer of fluorinated alcohol-soluble nylon resin in which tin oxide and carbon particles are dispersed (volume resistivity: $10^7$-$10^{10}$ ohm·cm, surface roughness (JIS ten-point average surface roughness Rz): 1.5 μm, layer thickness: about 5 μm).

Incidentally, in this embodiment, a power source S11 is constituted only by a DC power source, and a power source S12 is constituted by a DC power source and an AC power source. As a result, the surface of the rotating photosensitive drum 1 is contact-charged to a predetermined polarity and a predetermined potential.

In this embodiment, the photosensitive drum 1 is uniformly charged to −500 V but specific charging bias control will be described later.

As shown in FIG. 1, the image forming apparatus 100 includes, as an information writing means for forming an electrostatic latent image on the charged surface of the photosensitive drum 1, an exposure device 3 which is an exposure means.

In this embodiment, the exposure device 3 is a laser beam scanner using a semiconductor laser. The laser beam scanner 3 outputs laser light (beam) L modulated correspondingly to an image signal sent from an unshown host processing device such as an image reading device to a printer side. Then, the uniformly charged surface of the rotating photosensitive drum 1 is subjected to laser scanning exposure (image exposure) at an exposure portion (exposure position) b.

By this laser scanning exposure, the potential of the surface of the photosensitive drum 1 which has been irradiated with the laser light L is lowered, so that the electrostatic latent images are successively formed on the rotating photosensitive drum 1 surface correspondingly to image information obtained.

As shown in FIG. 1, the image forming apparatus 100 includes a developing device 4 as a developing means for reversely developing the electrostatic latent image into a toner image (developer image) by supplying the toner in accordance with the electrostatic latent image on the photosensitive drum 1.

In this embodiment, the developing device 4 employs a two-component contact developing type in which the development is effected while bringing a magnetic brush of a two-component developer consisting of the toner and a carrier into contact with the photosensitive drum 1.

The developing device 4 includes a developing container 4*a* and a non-magnetic developing sleeve 4*b* as a developer carrying member. A part of an outer peripheral surface of the developing sleeve 4*b* is exposed to an outside of the developing device 4, and the developing sleeve 4*b* is disposed rotatably in the developing container 4*a*.

In the developing sleeve 4*b*, a magnet roller 4*c* is inserted and provided so as to be non-rotatably fixed. A developer coating blade 4*d* is provided opposed to the developing sleeve 4*b*. The developing container 4*a* accommodates a two-component developer 4*e* as a developer and at a bottom side in the developing container 4*a*, developer stirring members 4*f* are provided. Further, a toner for replenishment is accommodated in an unshown toner hopper.

The two-component developer 4*e* in the developing container 4*a* is principally a mixture of a non-magnetic toner and a magnetic carrier and is stirred by the developer stirring members 4*f*. In this embodiment, a volume resistivity of the magnetic carrier is about $10^{13}$ Ω·cm. The particle size (volume-average particle size measured by using a laser diffraction type particle size distribution measuring device ("HEROS", mfd. by JEOL Ltd.) in a manner that the particle size range of 0.5-350 μm is logarithmically divided into 32 decades and the median diameter of 50% in volume is used as the volume-average particle size) of the magnetic carrier is about 40 μm. The toner is triboelectrically charged to the negative polarity by friction with the magnetic carrier.

The developing sleeve 4*b* is disposed close and opposite to the photosensitive drum 1 while keeping the closest distance (S-D gap) from the photosensitive drum 1 at 350 μm. This opposing portion between the photosensitive drum 1 and the developing sleeve 4*b* is a developing portion c.

The developing sleeve 4*b* is rotationally driven at the developing portion c in an opposite direction (R3 direction) to the movement direction (R1 direction) of the photosensitive drum 1. By a magnetic force of the magnet roller 4*c* in the developing sleeve, a part of the two-component developer 4*e* in the developing container 4*a* is adsorbed and held as a magnetic brush layer on the outer peripheral surface of the developing sleeve 4*b*. This magnetic brush layer is rotationally conveyed by the rotation of the developing sleeve 4*b* and its thickness is adjusted to provide a predetermined thin layer, which is contacted to the surface of the photosensitive drum 1 to appropriately rub against the surface of the photosensitive drum 1 at the developing portion c.

To the developing sleeve 4*b*, a predetermined developing bias (voltage) is applied from a power source S2. In this embodiment, the predetermined bias voltage applied to the developing sleeve 4*b* is an oscillating voltage in the form of a DC voltage ($V_{DC}$) biased with an AC voltage ($V_{AC}$). More specifically, the predetermined bias voltage is the oscillating voltage in the form of the DC voltage of −350 V biased with the AC voltage (frequency: 8.0 kHz, peak-to-peak voltage: 1.8 KV, rectangular wave).

Then, the toner in the developer 4*e* which is coated as the thin layer on the surface of the rotating developing sleeve 4*b* and is conveyed to the developing portion c is selectively deposited, correspondingly to the electrostatic latent image, on the surface of the photosensitive drum 1 by an electric field generated by the developing bias, so that the electrostatic latent image is developed as a toner image. In this embodiment, the toner is deposited on the surface of the photosensitive drum 1 at an exposure (light) portion, so that the electrostatic latent image is reversely developed. At this time, a charge amount of the toner subjected to the development on the photosensitive drum 1 is about −25 μC/g in an environment of a temperature of 23° C. and an absolute water content of 10.6 g/m$^3$.

The thin developer layer, on the developing sleeve, having passed through the developing portion c is returned to a developer containing portion in the developing container by further rotation of the developing sleeve 4*b*.

In order to keep a toner content (concentration) of the two-component developer 4*e* in the developing container 4*a* at a level within a substantially constant range, the toner content of the two-component developer 4*e* in the developing container 4*a* is detected by, e.g., an optical toner content sensor. Then, depending on its detection information, the unshown toner hopper is driven and controlled, so that the toner in the toner hopper is replenished into the two-component developer 4*e* in the developing container 4*a*. The toner replenished into the two-component developer 4*e* is stirred by the stirring members 4*f*.

As shown in FIG. 1, the image forming apparatus 100 includes a transfer device 5 as a transfer means. In this embodiment, the transfer device 5 is a transfer roller. The transfer roller 5 is press-contacted to the photosensitive drum 1 with a predetermined urging force and their press-contact nip is a transfer portion d. To this transfer portion d, a recording material P is fed and conveyed from a sheet feeding mechanism (not shown) with predetermined control timing.

The recording material P fed to the transfer predetermined d is nipped and conveyed between the photosensitive drum 1 and the transfer roller 5 which are rotated. During the nip-conveyance, to the transfer roller 5, a transfer bias of a positive polarity opposite from the negative polarity as a normal charge polarity of the toner (+600 V in this embodiment) is applied. As a result, toner images on the photosensitive drum 1 surface are electrostatically transferred successively onto the surface of the recording material P which is nip-conveyed through the transfer portion d.

Incidentally, a constitution of the image forming apparatus 100 is not necessarily limited to the constitution in which the toner image is directly transferred from the photosensitive drum onto the recording material P but may also be a constitution in which the toner image is transferred from the photosensitive drum onto an intermediary transfer member for temporarily holding and conveying the toner image and then is transferred from the intermediary transfer member onto the recording material P.

The recording material P which passes through the transfer portion and is subjected to the transfer of the toner image thereon is successively separated from the surface of the photosensitive drum 1 and is conveyed to a fixing device 6. In this embodiment, the fixing device 6 is a heating roller fixing device, and the recording material P is subjected to fixing of the toner image by this fixing device 6 and is outputted as an image-formed product (print or copy).

Transfer residual toner somewhat remaining on the surface of the photosensitive drum 1 after the toner image transfer onto the recording material P at the transfer portion d is removed from the surface of the photosensitive drum 1 by a cleaning device 7 at a cleaning portion e.

Here, an example of the image forming apparatus using the cleaning device 7 as a transfer residual toner removing means is described but the above-disclosed technical concept is applicable to also a cleaner-less type image forming apparatus in which a charge optimizing means for the transfer residual toner is provided and the transfer residual toner is collected simultaneously with the development.

Next, an operation sequence of the image forming apparatus in this embodiment will be described.

Figure 3:
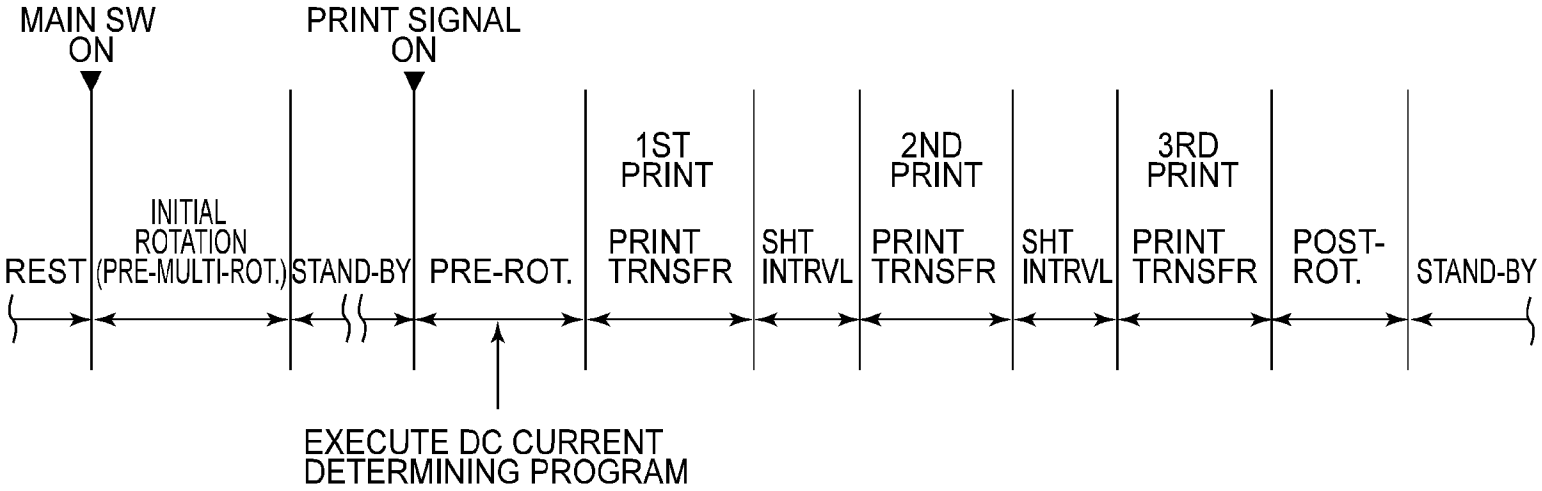
FIG. 3 is an operation sequence diagram of the image forming apparatus according to the present invention.

FIG. 3 shows an operation sequence of the above-described printer.

(1) Initial Rotation Operation (Pre-Multi-Rotation Step)

In an actuation operation period (warm-up period) during actuation of the printer, the photosensitive drum 1 is rotationally driven by turning a (main) power switch on and preparatory operations, of predetermined process devices (equipment), such as warm-up of the fixing device 6 to a predetermined temperature are executed.

(2) Preparatory Rotation Operation for Printing (Pre-Rotation Step)

In a preparatory rotation operation period, before image formation, from print signal input until an image forming (printing) step operation is actually performed, this operation is executed in succession to the initial rotation operation when the print signal is inputted during the initial rotation operation.

When the print signal is not inputted, the drive of the main motor is once interrupted, after the initial rotation operation is completed, to stop the rotational drive of the photosensitive drum, so that the printer is kept in a stand-by (waiting) state until the print signal is inputted. When the print signal is inputted, the preparatory rotation operation for printing is executed.

(3) Printing Step (Image Forming Step)

When the preparatory rotation operation for printing is completed, an image forming process with respect to the rotating photosensitive drum is carried out and then the toner image formed on the rotating photosensitive drum surface is transferred onto the recording material and fixed by the fixing device, so that the image-formed product is printed out.

In the case of a continuous printing mode, the above-described printing step is repeatedly performed correspondingly to a pre-set number of sheets (n sheets).

(4) Sheet Interval Step

This step corresponds to a non-sheet-passing state period from after a trailing end of a recording material passes the transfer position d until a leading end of a subsequent recording material reaches the transfer position d.

(5) Post-Rotation Operation

In a predetermined period, the post-rotation operation is performed in a manner such that the main motor drive is continued for a time, even after the printing step for a final recording material is completed, to rotationally drive the photosensitive drum, thus performing a predetermined post-operation.

(6) Stand-by

When the predetermined post-operation is completed, the main motor drive is stopped to stop the rotational drive of the photosensitive drum and then the printer is kept in a stand-by state until a subsequent print start signal is inputted.

In the case of printing on only one sheet, after completion of the printing, the printer is in a stand-by state after completion of the post-rotation operation.

In the stand-by state, when the print start signal is inputted, the printer goes to the pre-rotation step.

During the above-described (3) Printing step corresponds to during image formation. Further, during the above-described (1) Initial operation, (2) Preparatory rotation operation for printing, (4) Sheet interval, and (5) Post-rotation operation correspond to during non-image formation.

Next, a charging bias applying system with respect to each of the first charging roller 21 and the second charging roller 22 will be described.

Figure 4:
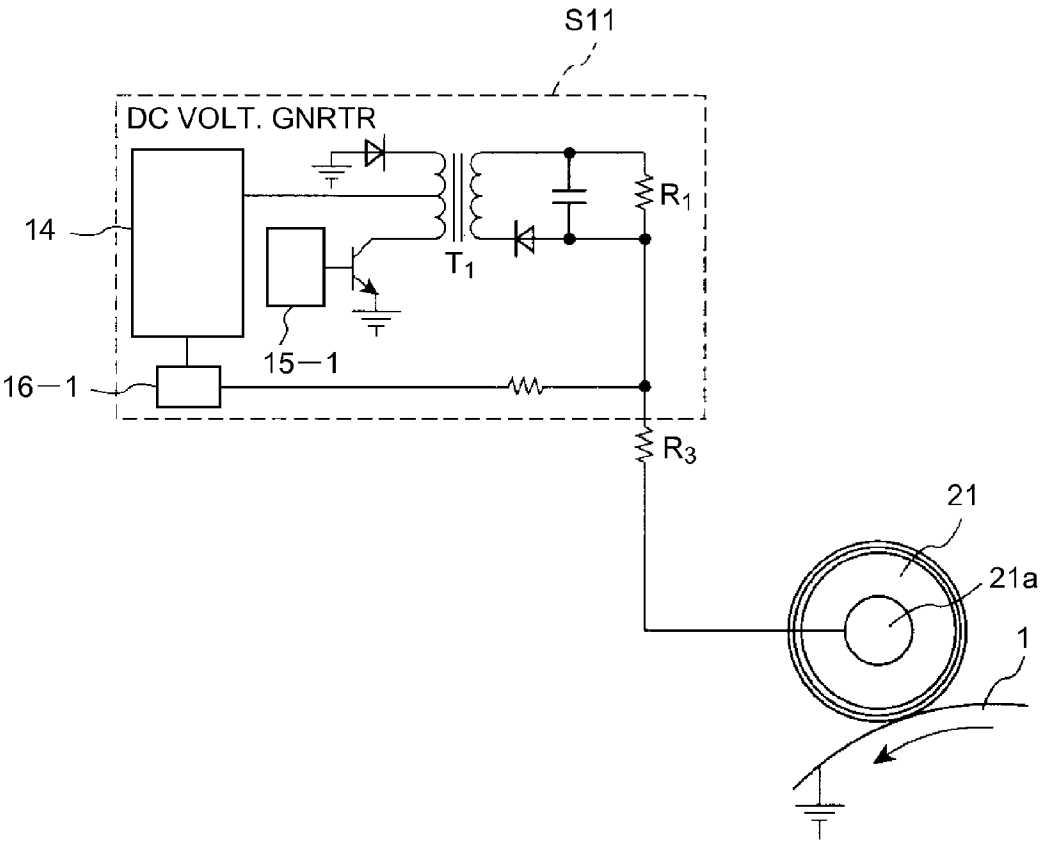
FIG. 4 is a power source circuit view of a DC voltage applying system with respect to the charging roller.
Figure 5:
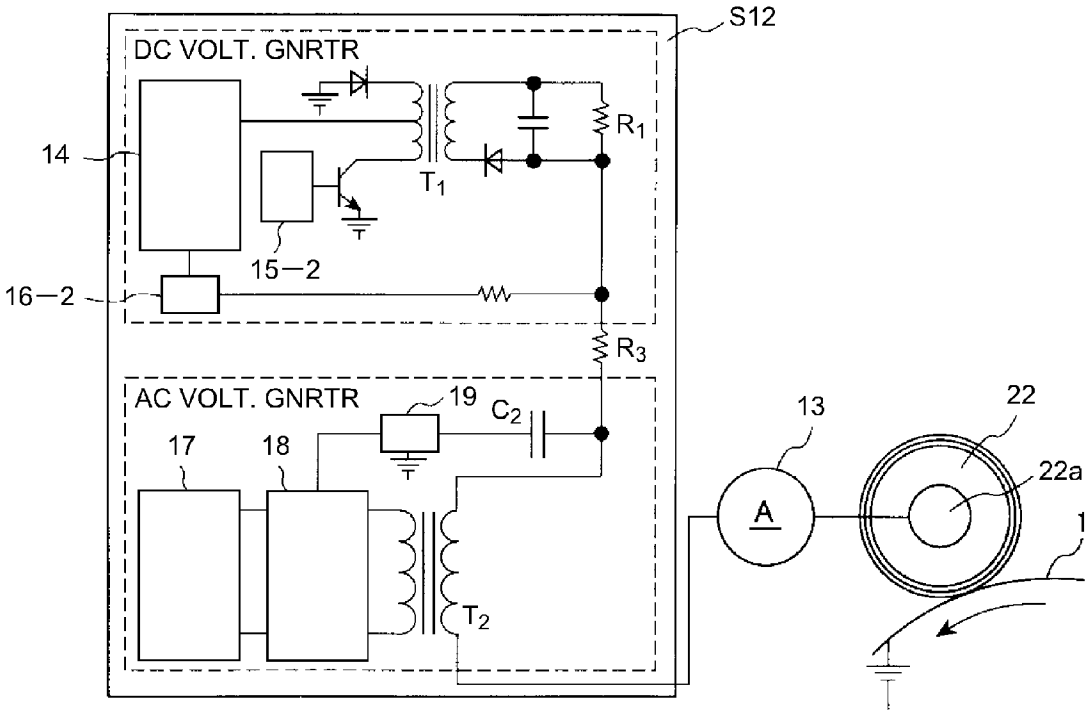
FIG. 5 is a power source circuit view of an AC voltage applying system with respect to the charging roller.

FIGS. 4 and 5 are power source circuit diagrams of the charging bias applying systems with respect to the first charging roller 21 and the second charging roller 22, respectively.

As shown in FIG. 4, with respect to the first charging roller 21, a power source S11 as a voltage applying means includes a DC power source. A DC voltage is a constant-voltage-outputted from a DC voltage generating portion including a switching circuit 15-1 and a transformer $T^1$. A control circuit 14 as a power source control means detects the DC voltage via resistor $R^1$ by a voltage detecting circuit 16-1 and then stabilizes a DC voltage output on the basis of output information of the circuit 16-1.

The peripheral surface of the rotating photosensitive drum 1 is electrically charged to a predetermined potential by applying a DC voltage (bias voltage Vdc) from the power source S11 to the charging roller 2 via the core metal 21*a*.

On the other hand, as shown in FIG. 5, with respect to the second charging roller 22, a power source S12 as the voltage applying means includes a DC power source (DC voltage generating portion) and an AC power source (AC voltage generating portion).

The DC voltage is constant-voltage-outputted from the DC voltage generating portion including a switching circuit 15-2 and a transformer $T^1$. The control circuit 14 detects the DC voltage via a register $R^1$ by a voltage detecting circuit 16-2 and then stabilizes a DC high-voltage output on the basis of output information of the circuit 16-2.

The AC voltage is constant-current-outputted from the AC voltage generating portion including a transformer $T^2$. The control circuit 14 detects the AC current via a capacitor $C^2$ by a current detecting circuit 19 and then controls, on the basis of output information of the circuit 19, gain of an amplifier circuit 18 connected to a sinusoidal oscillation circuit 17. Finally, the DC and AC voltages are superposed via a resistor $R^3$. A waveform of the AC component is appropriately selected from sine wave, rectangular wave, triangular wave and the like. It is also possible to use a rectangular voltage formed by periodically turning the power source on and off. The peripheral surface of the rotating photosensitive drum 1 is electrically charged to a predetermined potential by applying a predetermined oscillating voltage in the form of a DC voltage biased with an AC voltage having a frequency f (i.e., bias voltage Vdc+Vac) from the power source S12 to the charging roller 22 via the core metal 22*a*.

If there is a difference between the charge potential of the photosensitive member (roller) after passing through the upstream charging roller and the DC voltage applied to the downstream charging roller, a DC current flows between the downstream charging roller and the photosensitive member. Incidentally, depending on a magnitude correlation between the surface potential of the photosensitive member charged by the upstream charging roller and the DC voltage applied to the downstream charging roller, a flowing direction is different, the DC current flows between the downstream charging roller and the photosensitive member. When the DC current flowing between the downstream charging roller and the photosensitive member is large, a surface potential uniformity-enhancing performance of the downstream charging roller at the photosensitive member surface is lowered. Therefore, in the present invention, while applying the DC voltage to the downstream charging roller, the DC voltage is controlled so that the flowing DC current falls within a predetermined range.

That is, when the surface potential of the photosensitive member charged by the upstream charging roller is different from an assumed surface potential, In this embodiment, a DC current value measuring circuit 13 as a current detecting means for measuring a value of the DC current passing through the second charging roller 22 via the photosensitive drum 1 is provided, and information on a measured DC current value is inputted from this DC current value measuring circuit 13 into the control circuit 14. The control circuit 14 has the function of controlling a value of the DC voltage to be applied from the DC power source S11 to the first charging roller 21, a value of the DC voltage to be applied from the DC power source S12 to the second charging roller 22 and a value of peak-to-peak voltage or AC current of the AC voltage to be applied from the power source S12 to the second charging roller 22.

Further, the control circuit 14 has the function of executing the arithmetic computation and determining program of the DC bias to be applied to the charging rollers 21 and 22 in the charging process in the printing (image forming) step on the basis of the DC current value information inputted from the DC current value measuring circuit 13.

Next, a control method of the charging bias to be applied to the charging roller 22 will be described in detail. Incidentally, the control in this embodiment was effected in an environment of a temperature of 23° C. and a humidity of 50% RH.

In this embodiment, the image forming apparatus was operated without forming the image under a constant condition that the charging DC bias applied to the first charging roller 21 was −1100 V, the charging AC bias applied to the second charging roller 22 was 1500 Vpp (peak-to-peak voltage), the developing DC bias was −350 V and the transfer bias was +600 V.

The charging DC bias applied to the second charging roller 22 was outputted by so-called constant-current control so that the value of the DC current, of the second charging roller 22, passing through the DC current measuring circuit 13 is zero.

Here, for explanation, the photosensitive drum potential when the image forming apparatus is operated without forming the image is illustrated but in actuality, the charging bias control is effected simultaneously during the image formation (during the image forming step).

Figure 6:
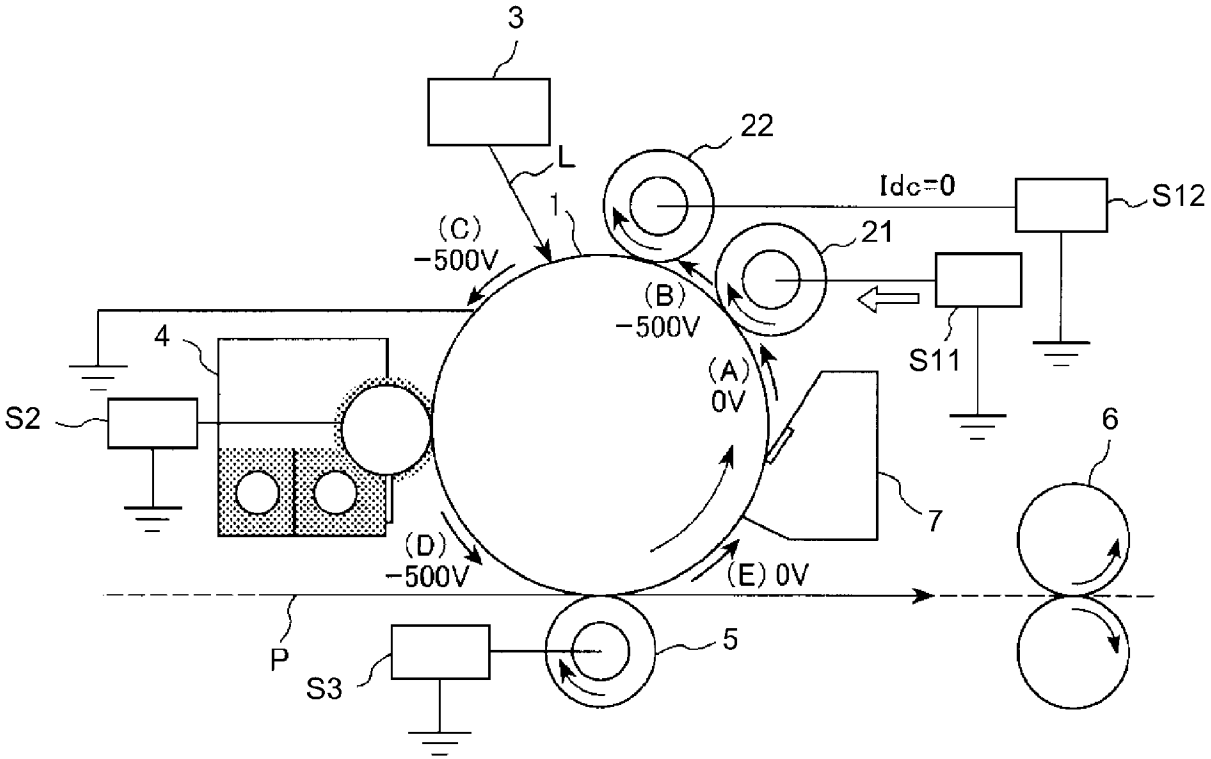
FIG. 6 is a schematic view showing surface potentials of a photosensitive drum during execution of charging control in Embodiment 1.

FIG. 6 is a schematic view showing surface potentials at respective positions of the photosensitive drum 1 when the charging bias control in this embodiment is effected.

As shown in FIG. 6, at a position (A), the surface potential of the photosensitive drum 1 immediately before the first charging roller 21 is 0 V.

Here, first, the surface potential of the photosensitive drum 1 after passing through the first charging roller 21 will be considered. With respect to the charging DC bias applied to the first charging roller 21, by applying a voltage which is not less than a discharge start voltage in the DC charging type, the surface potential can be set at the dark portion potential during the image formation and thus can be converged.

Figure 7:
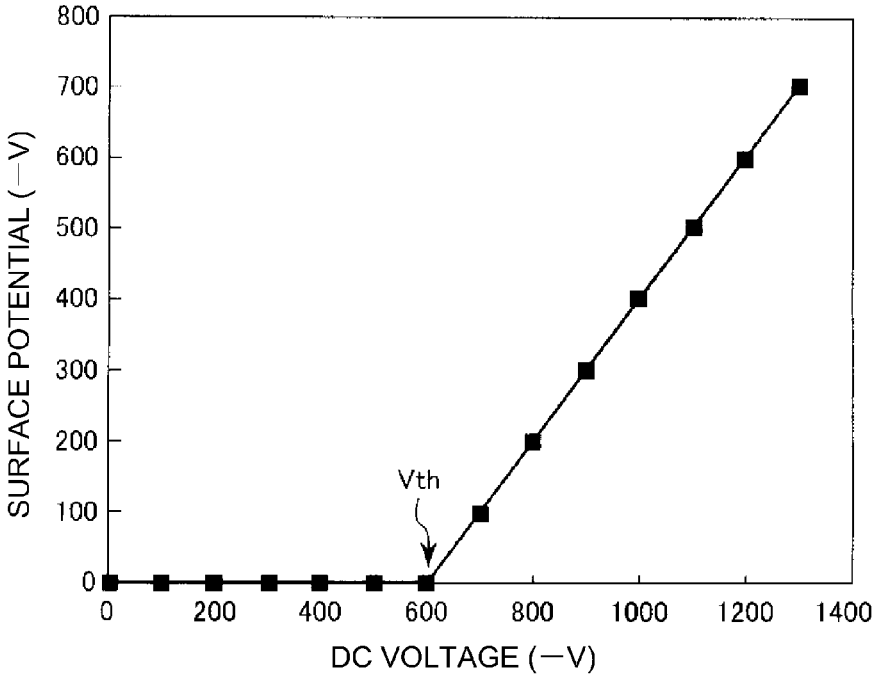
FIG. 7 is a graph showing a relationship between a DC voltage applied to the charging roller and a photosensitive drum surface potential.

FIG. 7 is a graph showing a relationship between the DC voltage with respect to the charging roller 21 used in this embodiment in the above environment and the photosensitive drum surface potential. In this embodiment, as shown in FIG. 6, the DC voltage was set at −1100 V so that the surface potential of the photosensitive drum at a position (B) in FIG. 6 is −500 V.

Therefore, it is understood that the surface potential of the photosensitive drum 1 passing through the charging roller 21 is changed from 0 V (at the position (A) in FIG. 6) to −500 V (at the position (B) in FIG. 6) by the DC bias applied to the charging roller 21.

Next, the photosensitive drum surface potentials before and after passing through the second charging roller 22 will be considered.

The charging AC bias applied to the second charging roller 22 may only be required to be the peak-to-peak voltage (Vpp) which is two times the discharge start voltage Vth in the DC charging type. In such a condition, it is known that the surface potential of the photosensitive drum passing through the charging roller 22 converges to the same potential as the applied DC bias.

As shown in FIG. 7, the discharge start voltage Vth is about 600 V (absolute value) and therefore the AC bias to be applied may only be required to be not less than 1200 Vpp which is two times the discharge start voltage Vth.

In this embodiment, the AC voltage applied to the second charging roller 22 is 1500 Vpp in view of a safety factor, thus uniformly charging the photosensitive drum surface after passing through the charging roller 22 to the surface potential of −500 V (at the position (C) in FIG. 6).

On the other hand, when the value of the DC current passing through the DC current measuring circuit 13 for the second charging roller 22 is zero, the photosensitive drum surface potential before and after passing through the second charging roller 22 is not changed. Therefore, it is most preferable that the drum potential after passing through the first charging roller 21 is set at −500 V and thus the DC voltage applied to the second charging roller 22 is set at −500 V (at the position (B) in FIG. 6).

Therefore, the surface potential of the photosensitive drum 1 passing through the second charging roller 22 causes the surface potential of the photosensitive drum 1 charged by the first charging roller 21 to further converge to a uniform potential.

The charged surface of the photosensitive drum 1 reaches the developing portion c by the rotation of the photosensitive drum 1 while keeping its surface potential at −500 V but a potential difference between the surface potential (−500 V) and the developing DC bias (−350 V) is small and therefore the drum potential is not changed even after passing through the developing portion c, thus being kept at −500 V (at position (D) in FIG. 6).

Then, the charged surface of the develop 1 reaches the transfer portion d by the rotation of the photosensitive drum 1 while keeping its surface potential at −500 V, and the surface potential becomes 0 V (at position (E) in FIG. 6) by the electric discharge due to the potential difference between the surface potential (−500V) and the transfer bias (+600 V) and then the photosensitive drum surface reaches the charging portion again.

Thus, by variably controlling the DC bias applied to the second charging roller 22 while effecting the control, it is possible to charge the photosensitive drum surface after passing through the charging roller 22 to a uniform potential.

In actually, in the case where the charging bias control is effected simultaneously with the image formation, various biases were set at constant values such that the charging DC bias applied to the first charging roller 21 was −1100 V, the charging AC bias applied to the second charging roller 22 was 1250 Vpp, the developing bias was −350 V, and the transfer bias was +600 V.

Similarly as during the bias control, the DC bias applied to the second charging roller 22 is outputted by so-called constant-current control so that the value of the DC current passing through the DC current measuring circuit 13 for the second charging roller 22 is zero.

In this case, the biases other than the charging AC bias applied to the charging roller 22 are similar to those in the bias setting during the image formation. Here, the charging AC bias is a value slightly larger than 1200 Vpp which is the discharge start voltage, and an AC discharge current amount is about 10 μA.

In this case, the charging AC bias applied to the charging roller 22 is different but there is no change in that AC electric discharge is effected by applying the AC bias which is not less than 1200 Vpp, and therefore the potentials of the photosensitive drum 1 at the respective positions during the image formation are similar to those in FIG. 6.

Figure 8:
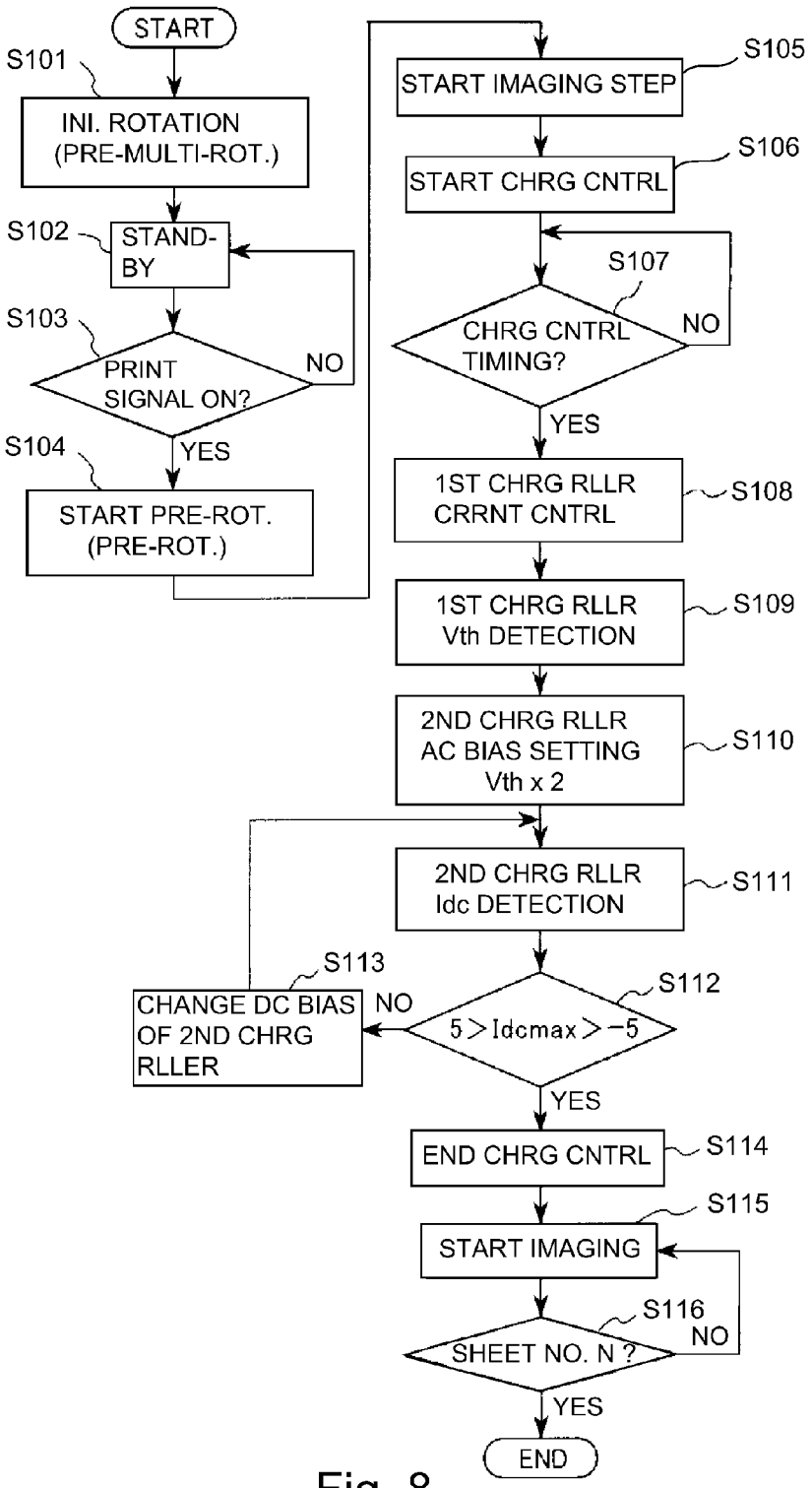
FIG. 8 is a flow chart of control in Embodiment 1.
Figure 9:
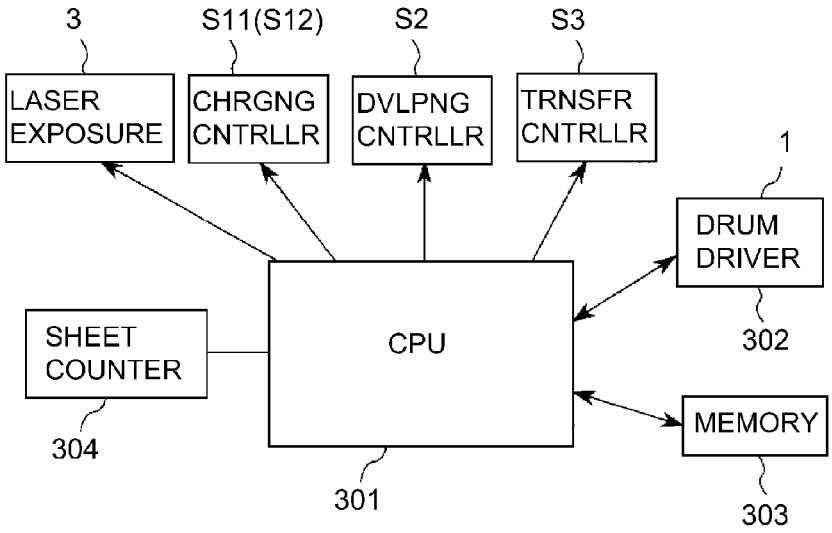
FIG. 9 is a block diagram showing a relationship between a CPU (control means) and respective portions of the image forming apparatus.

FIG. 8 shows a flow chart in the above-described charging bias control. FIG. 9 is a block diagram showing respective process means of the image forming apparatus and a CPU (apparatus main assembly control means) 301 for effecting integration control of the entire image forming apparatus. The control means 301 controls the respective portions of the image forming apparatus in accordance with a program stored in a memory 303. Also referring to FIG. 3, a bias control operation will be described.

START: The (main) power switch is turned on.

S101: When the power switch is turned on, the control means 301 rotationally drives the photosensitive drum 1 in order to execute the initial rotation operation (pre-multi-rotation step) and executes the preparatory operations, of the predetermined process devices, such as warm-up of the fixing device 6 to the predetermined temperature. Thereafter, the printer (image forming apparatus) is placed in a stand-by state (S102).

S103 and S104: In the stand-by state, when the print signal is inputted (turned on), the preparatory rotation operation before the image formation is executed in a period until the image forming (printing) step operation is actually performed. Also when the print signal is inputted during the initial rotation operation, after the end of the initial rotation operation, the preparatory rotation operation is executed. In the case where the print signal is not inputted, the control means 301 once interrupts the drive of the main motor, after the initial rotation operation is completed, to stop the rotational drive of the photosensitive drum, and keeps the printer in the stand-by (waiting) state until the print signal is inputted.

S105: When the predetermined preparatory rotation operation for printing is ended, then the image forming step is started to execute the image forming process with respect to the photosensitive drum 1.

S106: When the image forming step is started, the control means 301 starts the charging control and first judges charging control timing. The control means 301 executes the charging control step when it judges the time is the charging control timing. In the case where the time is not the charging control timing, the control means 301 awaits the input of a charging control timing signal and then executes the charging control step (after the input of the signal). In the case where the control means 301 judges that the time is not the charging control timing, the operation goes to S115 without performing the charging control step and then it is also possible to continue the image forming process.

S108: In the case where the control means 301 judges that the time is the control timing, the control means 301 actuates the control circuit (power source control means) 14 to successively apply the DC voltages to the first charging roller 21, thus executing discharge current control to effect DC bias setting so as to provide a desired potential.

S109: During the above-described discharge current control, the voltage detecting circuit 16-1 detects the discharge start voltage Vth with respect to the first charging roller 21.

S110: The control circuit 14 determines the AC voltage (Vth×2) with respect to the second charging roller 22 from a result of the above detection.

S111: In a bias application state by the first charging roller 21, a current value Idcmax is measured by the DC current detecting circuit 13 of the second charging roller 22.

S112: Judgment as to whether the current value satisfies 5>Idcmax>−5 is executed.

S113: In the case where Idcmax is out of the desired range, the DC voltage value of the second charging roller 22 is changed so that Idcmax converges to a value within the predetermined range. After the change, the operation is returned to S111 to execute a loop handling.

S114: In the case where the execution result falls within the predetermined range, the charging control is ended, and the control means 301 actuates the laser exposure means 3, the developing means 4, the transfer means 15, and the like to start the image formation (S115). As desired, the image formation on a predetermined number (N) of sheets (S116), and then the image formation is ended.

In this embodiment, the predetermined current Idcmax in S112 was obtained in the following manner.

Figure 10:
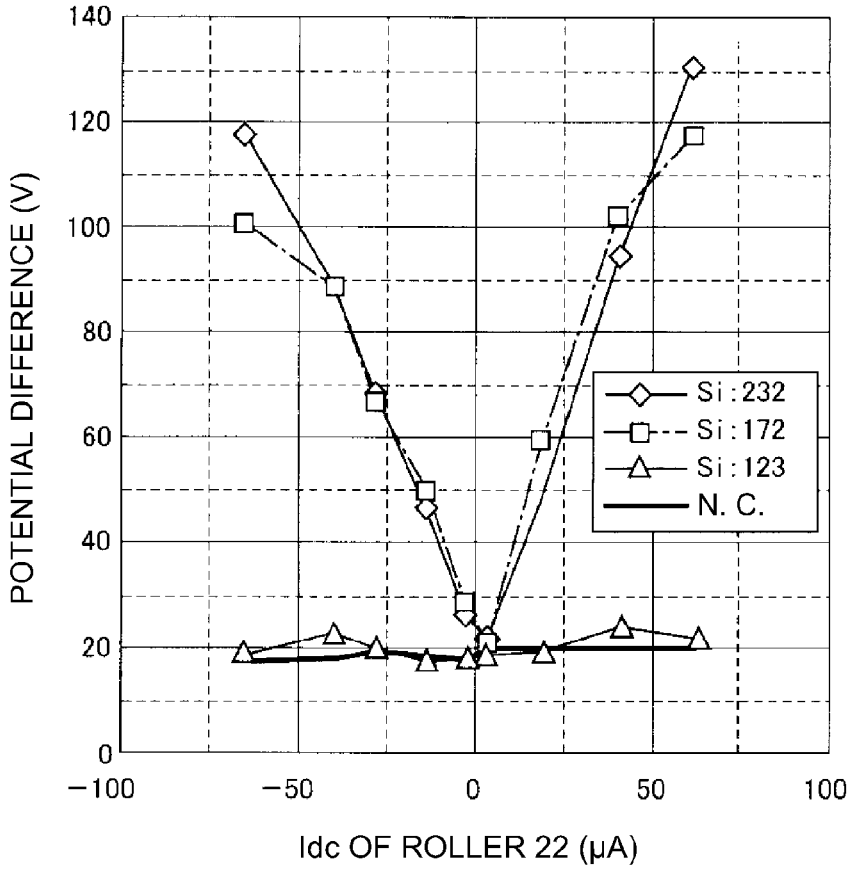
FIG. 10 is a graph showing a potential convergence property with respect to a DC current value.

FIG. 10 shows a state when an external additive (Si used in this embodiment) is separately and locally applied onto and deposited on the second charging roller 22 in this embodiment while causing the electric discharge, and the resultant second charging roller 22 is provided in the constitution in this embodiment. The value of the DC current flowing into the second charging roller 22 is taken as the abscissa, and the ordinate represents a potential difference between the potential of the photosensitive drum surface after the passing during non-contamination ("N.C.") and the potential at a contaminated position.

Numerical values for Si in FIG. 10 represent strength (cps/mA) as measured by an X-ray analytic microscope (mfd. by HORIBA, Ltd.) when Si is applied onto respective positions, and a larger value represents a larger amount of contamination.

Incidentally, in this embodiment, a relative dielectric constant $\in=3$, a film (layer) thickness $d=2.50\times10^{-5}$ (m), a peripheral speed P=0.130 (m/s), a photosensitive drum longitudinal length L=0.33 (m), a spatial dielectric constant in a vacuum $\in0=8.85\times10^{-12}$ (F/m), and the surface potential V of the photosensitive drum 1 after being charged by the second charging roller 22 was V=−500 (V).

Here, when a tolerable range on the image with respect to the ordinate (the potential difference between the potential of the photosensitive drum surface after the passing during the non-contamination and the potential during the contamination) was judged from an actual image, the tolerable range was 28 V. From FIG. 10, the current value which allows 28 V is within ±5 μA (5>Idcmax>−5), i.e., the predetermined current Idcmax in this embodiment is ±5 μA.

Next, by using ±5 μA which is the above-obtained predetermined current Idcmax in this embodiment, the predetermined current Idcmax under a general condition will be obtained.

Here, in the case where the relative dielectric constant of the photosensitive drum 1 is $\in$, the film thickness of the photosensitive drum 1 is d (m), the peripheral speed of the photosensitive drum 1 is P (m/s), the longitudinal length of the photosensitive drum 1 is L (m), the spatial dielectric constant in a vacuum is $\in0$ (F/m), and the surface potential of the photosensitive drum 1 after being charged by the second charging roller 22 is V (V), $I=V\times\in\times\in0\times P\times L/d$ is satisfied.

In this embodiment, the above-described setting condition is applied and therefore the current I necessary to charge the photosensitive drum 1 in this embodiment is I=V×∈×∈0×P×L/d=−22.8 μA.

By making reference to Table 1 shown below, it is understood that the predetermined current Idcmax under the general condition is Idcmax=0.22×V×∈×∈0×P×L/d.

That is, according to this embodiment, when the surface potential of the photosensitive drum 1 after being charged by the second charging roller 22 is V (V), a value of current Idc (A) is constituted so as to satisfy the following relationship:

$$|Idc|=|0.22\times V\times\in\times\in 0\times P\times L/d|$$

TABLE 1

| | Necessary current | Idcmax |
|---|---|---|
| EMB. | $(-500)\times 3\times 8.85\times 10^{-12}\times 130\times 0.33/2.50\times 10^{-5}=22.8$ (μA) | ±5 μA |
| General condition | V × ϵ × ϵ0 × P × L/d) | ±\|(5/22.8) × V × ϵ × ϵ0 × P × L/d)\| ≈ ±\|0.22 × V × ϵ × ϵ0 × P × L/d\| |

Next, an effect on a potential rushing into the second charging roller 22 will be described.

Figure 11:
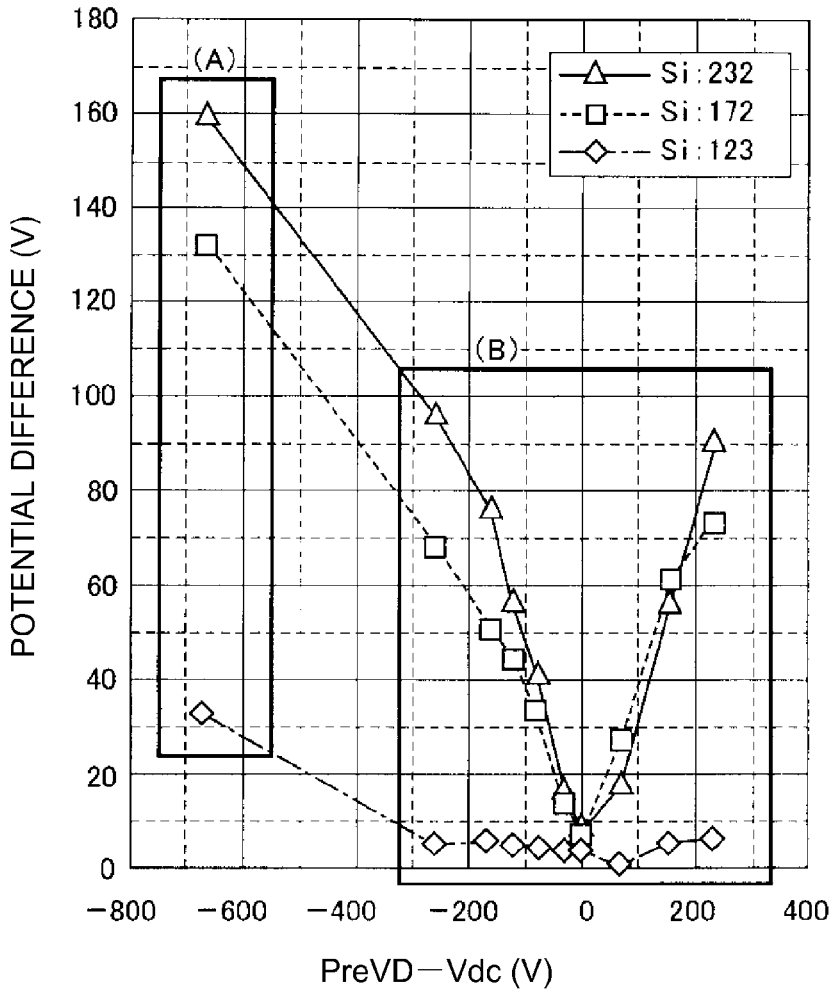
FIG. 11 is a graph showing a potential convergence property with respect to an inrush potential and an applied DC voltage difference.

FIG. 11 is a graph, with respect to the second charging roller 22, in which the abscissa represents a difference between an inrush potential (at the position (B) in FIG. 6) and a DC voltage applied to the second charging roller 22 and the ordinate represents a potential difference between a potential of the photosensitive drum surface after the passing during the non-contamination and a potential at each of contaminated positions.

In FIG. 11, (A) shows the potential difference after the passing at each contaminated position (portion) in the constitution of the single charging roller, and (B) shows the potential difference after the passing at each contaminated position in the constitution in this embodiment. From FIG. 11, it is understood that an effect of most uniformizing potential non-uniformity generated at a point of the smallest state difference, i.e., in the neighborhood of the potential difference of 0 V is achieved.

This point is a portion where the photosensitive drum surface potential rushing into the second charging roller 22 is the same as the value of the DC voltage applied to the second charging roller 22 and therefore the potential difference is 0 V, i.e., the DC current value is also 0 μA.

From the above, with respect to the potential non-uniformity (problem) which was not able to be solved by the single charging roller constitution, by applying the constitution and control in this embodiment, the problem can be solved.

Further, in order to explain the effect in this embodiment based on a potential distribution, a model close to a production model (condition) was prepared and the potential distribution with respect to a change in time was calculated by simulation.

As a calculating method, finite element method is employed and with respect to the potential distribution, on the basis of Poisson's equation and Paschen's law in a generalized coordinate system, the state distribution was calculated by adopting charge movement amount, gap discharge (spark discharge) and surface discharge (creepage) model.

The high-voltage condition and the like used in this embodiment were set as parameters and the potential at the position (B) in FIG. 6 was set at various values to execute the calculation.

Figure 12:
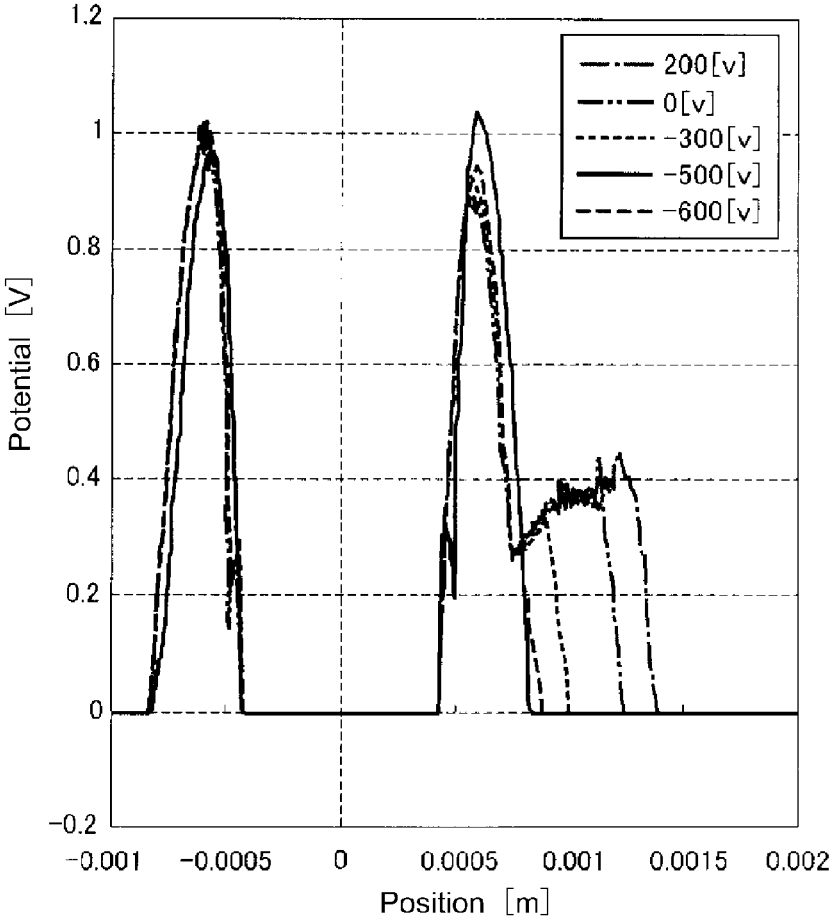
FIG. 12 is a graph showing a spark discharge distribution amount with respect to the inrush potential during a constant applied DC voltage.

FIG. 12 shows a distribution, on the basis of the calculated values in this embodiment, of the gap discharge amount, i.e., the spark discharge amount on the photosensitive drum surface, in which the abscissa represents the position and the ordinate represents a normalized value of the distribution amount. Various lines are defined by using the potentials at the position (B) in FIG. 6 as a series.

Incidentally, 0 (mm) on the ordinate is the center of the nip where the second charging roller 22 and the photosensitive drum 1 contact each other, and a positive area is an upstream area with respect to a rotational direction of the photosensitive drum 1 and a negative area is a downstream area with respect to the photosensitive drum rotational direction.

From FIG. 12, it is understood that there is a tendency that the spark discharge distribution in a certain area is narrowed as the potential rushing into the second charging roller 22 is closer to the DC voltage applied to the second charging roller 22.

This shows that discharge which accelerates the contamination generated by normal discharge of the spark discharge at a position in a first area (which is not in the neighborhood of the nip) based on Paschen's law at the inrush portion is not generated under the condition in this embodiment.

Incidentally, herein, the normal discharge refers to discharge from the charging roller 22 to the photosensitive drum 1.

In a discharge area other than the above discharge area, potential uniformization by normal discharge and reverse discharge caused by the AC charging occurs and therefore the potential of the photosensitive drum surface after passing through the second charging roller 22 converges to a target potential.

In this embodiment, the calculation is executed with respect to the structure in which the surface layer of the charging roller 22 includes a uniform resistance layer, but in reality, the charging roller 22 is contaminated with the developer (toner and external additive) or the like, so that the resistance of the surface layer is locally changed.

On this assumption, the calculation as to whether or not the effect of the present invention can be achieved even when the surface layer resistance condition of the charging roller 22 was executed. As a result, as shown in FIG. 13, it was found that a similar effect was brought about irrespective of the surface layer resistance values.

Figure 13:
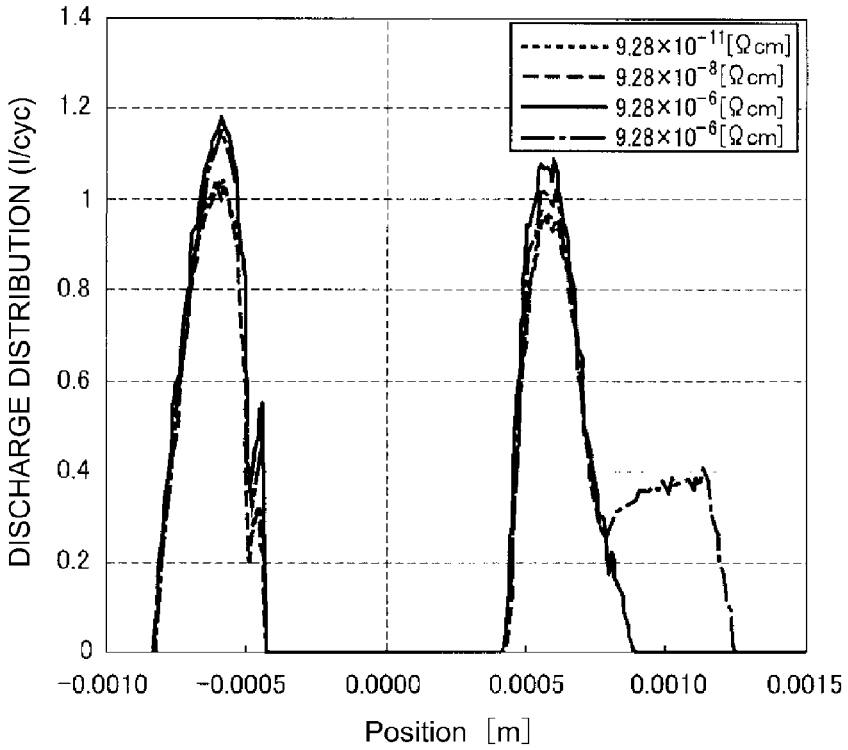
FIG. 13 is a graph showing a spark discharge distribution amount with a series of surface layer resistances.

In FIG. 13, with respect to a series of the surface layer resistance values of $9.28\times 10^{-6}$ Ω·cm, a chain line shows the discharge distribution amount when the control in this embodiment is not effected. In this state, when the image formation was effected, image defect due to the charging roller contamination occurred.

By executing the control in this embodiment, it is possible to provide the control means capable of keeping the charge potential at a uniform level even when the change of the surface layer resistance is caused by the contamination of the charging rollers 21 and 22 with the developer (toner and external additive) or the like.

In this embodiment, the image is formed at Vpp set at 1250 V so as to provide the AC discharge current amount of 10 μA during the image formation. By minimizing the AC discharge current amount, it is possible to considerably alleviate degrees of a deterioration of the photosensitive member and an occurrence of image flow (deletion).

According to this embodiment, the uniformizing effect by the AC discharge current can be obtained and therefore it is possible to perform uniform charging (charge removal), so that image quality improvement can be achieved. As described above, all of these operations are performed simultaneously during the image formation.

Further, the charging bias control in this embodiment can be executed simultaneously with the image formation and thus the control time is not required, so that there is the advantage such that the charging bias control does not adversely affect productivity.

As is understood from the above, in this embodiment, the AC voltage and the DC voltage are applied to the downstream second charging roller 22 while the DC voltage is applied to the upstream first charging roller 21. Further, in this case, the value of the DC voltage applied to the second charging roller 22 is repetitively controlled so that an absolute value of the DC current flowing into the second charging roller 22 is decreased.

Incidentally, in Embodiment 1, the charging bias control when the surface potential (residual potential) of the photosensitive drum 1 before the charging is 0 V was described.

In an actual image forming apparatus, various residual potentials are obtained depending on the bias setting of the respective high-voltage power sources, an operation environment, an operation history, the type of the developer used, and the like.

However, in this embodiment, the control of the second charging roller 22 can be executed without any trouble and can be proposed as an effective means for solving the problem.

Further, in this embodiment, the charging means for the first charging roller 21 is controlled by the DC charging but there is of no problem even when the charging means is controlled by the AC charging.

<Embodiment 2>

Next, Embodiment 2 will be described. A basic constitution of an image forming apparatus (printer) in this embodiment is similar to that in Embodiment 1. Therefore, elements (portions) having the same functions and constitutions as those in Embodiment 1 are represented by the same reference numerals or symbols and will be omitted from detailed description.

In Embodiment 1, the charging bias control is effected simultaneously during the image formation but may also be effected during non-image formation.

In this embodiment, the charging bias control is effected as interruption control after the image forming job (post-rotation operation).

Figure 14:
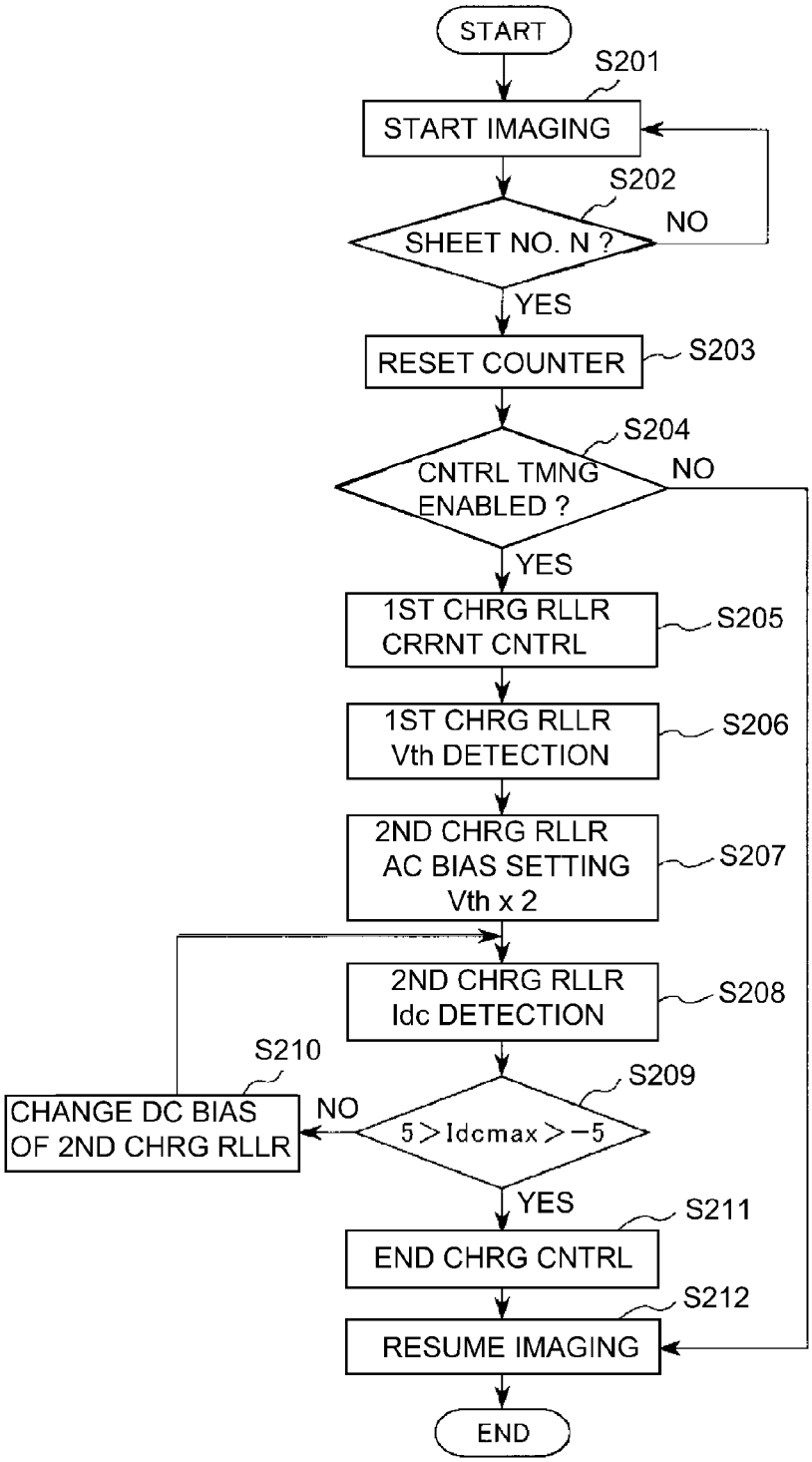
FIG. 14 is a flow chart of control in Embodiment 2.

FIG. 14 is a flow chart of the above-described charging bias control. Here, the charging bias control is an example of the case where it is effected as the interruption control during the image forming job.

By making reference to also FIGS. 3 and 8 described above, the bias control operation in this embodiment will be described.

The steps from "START" to "S105" in Embodiment 1, i.e., the main power switch turning-on, the initial rotation operation (pre-multi-rotation operation), the print signal input, the start of the preparatory operation for printing (pre-rotation step) and the start of the image forming step, are the same as those in this embodiment and therefore will be omitted.

S201: The control means 301 starts, after the preparatory rotation operation for printing (pre-rotation step) is ended, the image formation by starting the image forming step, and then controls the respective portions of the image forming apparatus to execute the image formation on the predetermined number of sheets.

S202: The control means 301 increments a sheet number counter 304 every completion of the image formation on one sheet and execute judgment as to whether or not the sheet number reaches the predetermined number N. In the case where the sheet number does not reach the predetermined number N, the image formation is maintained. In the case where the sheet number reaches the predetermined number N, the counter 304 is reset and then the operation goes to the charging control step (S203).

S204: The control means execute judgment of enabled/disabled of function of the charging control itself. In the case where the function is enabled, the charging control step is executed. In the case where the function is disabled, the operation goes to S212, so that the image formation is maintained.

S205 to S211: These steps are equivalent to S108 to S114 in Embodiment 1 described with reference to FIG. 8 and therefore will be omitted from description.

By effecting the control in this embodiment, even during the non-image formation, an effect similar to that in Embodiment 1 can be obtained. In addition, by effecting the control during the image formation, the control is effected every predetermined number of sheets also with respect to the charging roller which is contaminated with the developer (toner and external additive) or the like during continuous image formation, so that the control with robustness is realized.

<Other Embodiments>

In the above-described embodiments, the constitution in which the residual potential after the transfer is not particularly treated but reaches the charging portion as it is, is employed but a constitution in which a charge-removing device is provided, between the transfer portion d and charging portion a1, to the photosensitive drum and the residual potential is cancelled to provide the potential of 0 V may also be employed.

By the charge-removing device, the residual potential can be controlled uniformly and therefore the charge-removing device is effective in stably effecting the control in this embodiment. Further, at the image forming portion and non-image forming portion of the photosensitive drum 1, it is possible to suppress a degree of an occurrence of ghost due to a difference in residual charge amount.

The execution period of the arithmetic computation and determination program for an appropriate applied DC current value in the charging process of the printing step is not limited to during the image formation and during the post-rotation operation as in the case of the printer in the above embodiment. The computation and the program can also be executed during other non-image forming operations, i.e., during initial rotation operation, during preparatory rotation operation for printing, and during sheet interval step and can also be executed during a plurality of steps.

Further, with respect to the photosensitive drum 1 in each of the above-described embodiments, a charge injection layer having a surface resistance of $10^9$-$10^{14}$ Ω may also be provided as to assume a direct charge injection property. Even in the case where the charge injection layer is not used, it is possible to obtain a similar effect also, e.g., when the charge transporting layer has the surface resistance falling within the above-described range.

Further, as the photosensitive drums 1 in the above-described embodiments, an amorphous silicon photosensitive member including the surface layer having the volume resistivity of about $10^{13}$ Ω·cm may also be used.

In the above-described respective embodiments, the constitution in which the charging roller is used as a flexible contact charging member is employed but as another flexible contact charging member, it is possible to use those having a shape or material such as a fur brush, a felt, and cloth.

Further, by combining various materials, those having more proper elasticity, electroconductivity, surface property, and durability.

As described above, during the image formation, the DC current is detected while applying, to the second charging roller 22, the bias in the form of the DC voltage superposed with the AC voltage. Further, the potential of the photosensitive drum is made uniform by the second charging roller so that the absolute value of the DC current is decreased, preferably to 0 μA. As a result, while realizing the image quality improvement, it is possible to suppress the occurrence of improper charging due to the charging roller contamination.

Further, by executing the above-described charging bias control simultaneously with the image formation, the control time is not required and therefore the charging bias control can be effected without adversely affecting the productivity.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 021572/2011 filed Feb. 3, 2011, which is hereby incorporated by reference.

What is claimed is:

1. An image forming apparatus comprising:

a rotatable image bearing member;

a first charging member for electrically charging said image bearing member at a first charging portion by being supplied with a first DC voltage;

a second charging member provided downstream of the first charging portion with respect to a rotational direction of said image bearing member, said second charging member electrically charging said image bearing member, charged by said first charging member, at a second charging portion by being supplied with an oscillating voltage in the form of a second DC voltage biased with an AC voltage;

a toner image forming portion, provided downstream of the second charging portion and upstream of the first charging portion with respect to the rotational direction of said image bearing member, for forming a toner image on a surface of said image bearing member charged by said first charging member and said second charging member;

a current detecting portion for detecting a DC current passing through said second charging member; and a controller for controlling a voltage value of the second DC voltage on the basis of the DC current detected by said current detecting portion when the first DC voltage is applied to said first charging member and the second DC voltage is applied to said second charging member, wherein said controller controls the voltage value of the second DC voltage so that an absolute value of the DC current detected by said current detecting portion is smaller than a predetermined value.

2. An image forming apparatus according to claim 1, wherein a current value Idc passing through said second charging member satisfies the following relationship:

$$|Idc| \leq |0.22 \times V \times \in \times \in 0 \times P \times L/d|,$$

where V represents a surface potential (V) of said image bearing member after being charged by said second charging member, ∈ represents a relative dielectric constant of said image bearing member, ∈0 represents a spatial dielectric constant (F/m) in a vacuum, P represents a peripheral speed (m/s) of said image bearing member, L represents a longitudinal length (m) of said image bearing member, and d represents a thickness (m) of said image bearing member.

* * * * *